US010196954B2

(12) United States Patent
Lee et al.

(10) Patent No.: US 10,196,954 B2
(45) Date of Patent: Feb. 5, 2019

(54) REFORMING SYSTEM

(71) Applicants: HYUNDAI MOTOR COMPANY, Seoul (KR); KIA MOTORS CORPORATION, Seoul (KR)

(72) Inventors: Seung Woo Lee, Seoul (KR); Hong Kil Baek, Seoul (KR); Tae Won Lee, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/621,506

(22) Filed: Jun. 13, 2017

(65) Prior Publication Data

US 2018/0163593 A1 Jun. 14, 2018

(30) Foreign Application Priority Data

Dec. 13, 2016 (KR) ..... 10-2016-0169865

(51) Int. Cl.

| | |
|---|---|
| ***F01N 3/20*** | (2006.01) |
| ***F01N 3/08*** | (2006.01) |
| ***F01N 3/032*** | (2006.01) |
| ***F01N 3/023*** | (2006.01) |
| ***F02M 26/00*** | (2016.01) |

(52) U.S. Cl.

CPC ..... *F01N 3/2066* (2013.01); *F01N 3/0234* (2013.01); *F01N 3/0235* (2013.01); *F01N 3/0814* (2013.01); *F01N 3/0842* (2013.01); *F02M 26/00* (2016.02); *F01N 2240/30* (2013.01); *F01N 2240/36* (2013.01); *F01N 2410/00* (2013.01)

(58) Field of Classification Search

CPC . C01B 3/34; C01B 3/38; F01N 3/2066; F01N 3/0234; F01N 3/0235; F01N 3/0814; F02M 26/06; F02M 26/09; F02M 26/15; F02D 41/0065; F02D 19/0671

See application file for complete search history.

(56) References Cited

U.S. PATENT DOCUMENTS

| | | | | |
|---|---|---|---|---|
| 6,793,898 | B2 * | 9/2004 | Brown | B01J 19/088 123/DIG. 12 |
| 2004/0187483 | A1 * | 9/2004 | Dalla Betta | F01N 3/0814 60/286 |
| 2006/0042565 | A1 * | 3/2006 | Hu | F02M 27/02 123/3 |
| 2007/0193537 | A1 * | 8/2007 | Miyasaka | B01J 8/0221 123/538 |

(Continued)

*Primary Examiner* — Hieu T Vo
*Assistant Examiner* — Arnold Castro
(74) *Attorney, Agent, or Firm* — Brinks Gilson & Lione

(57) ABSTRACT

A fuel reforming system includes: an engine combusting reformed gas to generate mechanical power; an intake line connected to the engine to supply the reformed gas and air to the engine; an exhaust line connected to the engine to circulate the exhaust gas discharged from the engine; a fuel reformer provided at an exhaust gas recirculation (EGR) line diverging from the exhaust line; and a catalyst disposed at the exhaust line and purifying nitrogen oxide included in the exhaust gas at a front end of the fuel reformer. In particular, the fuel reformer mixes the fuel with the EGR gas which is a part of the exhaust gas and passes through the EGR line, and reforms the fuel mixed in the EGR gas.

7 Claims, 3 Drawing Sheets

(56) References Cited

U.S. PATENT DOCUMENTS

| | | | | |
|---|---|---|---|---|
| 2008/0168763 | A1* | 7/2008 | Ginter | B01D 53/9418 60/286 |
| 2008/0295501 | A1* | 12/2008 | Gong | F02M 25/12 60/299 |
| 2010/0224142 | A1* | 9/2010 | Iwamoto | B01D 53/9413 123/3 |
| 2011/0239646 | A1* | 10/2011 | Bennet | F01N 3/035 60/605.1 |
| 2013/0216473 | A1* | 8/2013 | Nicole | F01N 3/04 423/651 |
| 2013/0333639 | A1* | 12/2013 | Hoshino | B01J 23/96 123/3 |
| 2015/0075451 | A1* | 3/2015 | Inuzuka | F02D 41/0065 123/3 |
| 2015/0354483 | A1* | 12/2015 | Brewbaker | F02M 26/06 60/605.2 |
| 2018/0010555 | A1* | 1/2018 | Lee | F02M 26/09 |
| 2018/0128164 | A1* | 5/2018 | Lee | F02M 31/00 |
| 2018/0135486 | A1* | 5/2018 | Baek | C01B 3/366 |
| 2018/0163648 | A1* | 6/2018 | Baek | F02M 26/02 |

* cited by examiner

REFORMING SYSTEM

CROSS-REFERENCE TO RELATED APPLICATION

This application claims priority to and the benefit of Korean Patent Application No. 10-2016-0169865, filed Dec. 13, 2016, the entire contents of which are incorporated herein by reference.

FIELD

The present disclosure relates to a fuel reforming system.

BACKGROUND

The statements in this section merely provide background information related to the present disclosure and may not constitute prior art.

Generally, an exhaust gas recirculation (EGR) system is a system which is installed in a vehicle to decrease noxious exhaust gas.

This exhaust gas recirculation system reduces oxygen amount in a mixer by circulating a part of the exhaust gas discharged from the engine, reduces the amount of the exhaust gas, and reduces toxic matters in the exhaust gas.

Also, the exhaust gas discharged from the engine has high temperature, therefore the engine efficiency may be improved by utilizing the thermal energy of the exhaust gas.

Meanwhile, a fuel reformer is a device which changes fuel characteristics by using catalyst, and the fuel reformer may be applied to increase combustion efficiency or activate a post processing system.

For improvement of fuel reforming efficiency, it is important to attain sufficient activation temperature of a fuel catalyst. By the way, EGR gas has to be sufficiently heated to attain sufficient activation temperature for fuel reforming, however, it is difficult to attain activation temperature according to driving condition and supply amount of the EGR gas. We have discovered that there is a problem that reforming efficiency decreases because temperature of mixed gas decreases substantially during mixing of fuel and the EGR gas in a mixing portion of the fuel reformer.

SUMMARY

The present disclosure provides a fuel reforming system having a heat transfer structure for mixed gas and exhaust gas in a fuel reformer to reach at a sufficient activation temperature of a reforming catalyst for reforming reaction.

In one form of the present disclosure, a fuel reforming system includes: an engine configured to combust reformed gas and to generate mechanical power; an intake line connected to the engine and configured to supply the reformed gas and air to the engine; an exhaust line connected to the engine and configured to circulate exhaust gas discharged from the engine; a fuel reformer provided at an exhaust gas recirculation (EGR) line diverging from the exhaust line, and configured to mix the EGR gas with the fuel and to reform the fuel mixed in the EGR gas, wherein the EGR gas is a part of the exhaust gas and passes through the EGR line; and a catalyst disposed at the exhaust line and configured to purify nitrogen oxide included in the exhaust gas at a front end of the fuel reformer.

The fuel reformer may include: a housing; a mixing portion provided in the housing and being a space configured to mix the fuel supplied from outside and the EGR gas; a fuel injector installed at one side of the housing and configured to supply the fuel to the mixing portion; an EGR pipe connected to the mixing portion and configured to flow the EGR gas; a heat transfer portion installed at a rear end of the mixing portion and configured to increase a temperature of the mixed fuel and EGR gas by heat of the exhaust gas; and a reforming catalyst portion provided at a rear end of the heat transfer portion and configured to reform the mixed fuel and EGR gas.

The heat transfer portion may include a penetration member having a plurality of penetration holes configured to circulate the fuel and EGR gas mixed in the mixing portion toward the reforming catalyst portion; and an exhaust gas inlet and an exhaust gas outlet through which exhaust gas flows in and out such that the exhaust gas circulates around the plurality of penetration holes.

In one form, the fuel reforming system may further include a compressor connected to the intake line and configured to compress the reformed gas and air to supply to the engine; and a turbine connected to the exhaust line and configured to be rotated by the exhaust gas to generate power.

The catalyst may include a lean NOx trap (LNT) which traps the nitrogen oxide included in the exhaust gas in a lean condition and desorbs the trapped nitrogen in a rich condition. The LNT restores the nitrogen oxide included in the exhaust gas or the desorbed nitrogen oxide.

The catalyst may include a selective catalytic reducer (SCR) configured to restore the nitrogen oxide included in the exhaust gas by using a reducing agent.

An EGR valve configured to adjust a flow rate of the reformed gas, and an EGR cooler disposed at a rear end of the EGR valve and configured to cool the reformed gas may be installed at the EGR line.

The reformer may be installed at a front portion of the EGR cooler in the EGR line.

According to an exemplary form of the present disclosure, a heat transfer structure of mixed gas and exhaust gas in a fuel reformer is provided to attain sufficient activation temperature of reforming catalyst for reforming reaction, therefore increasing generation of hydrogen and improves reforming efficiency.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
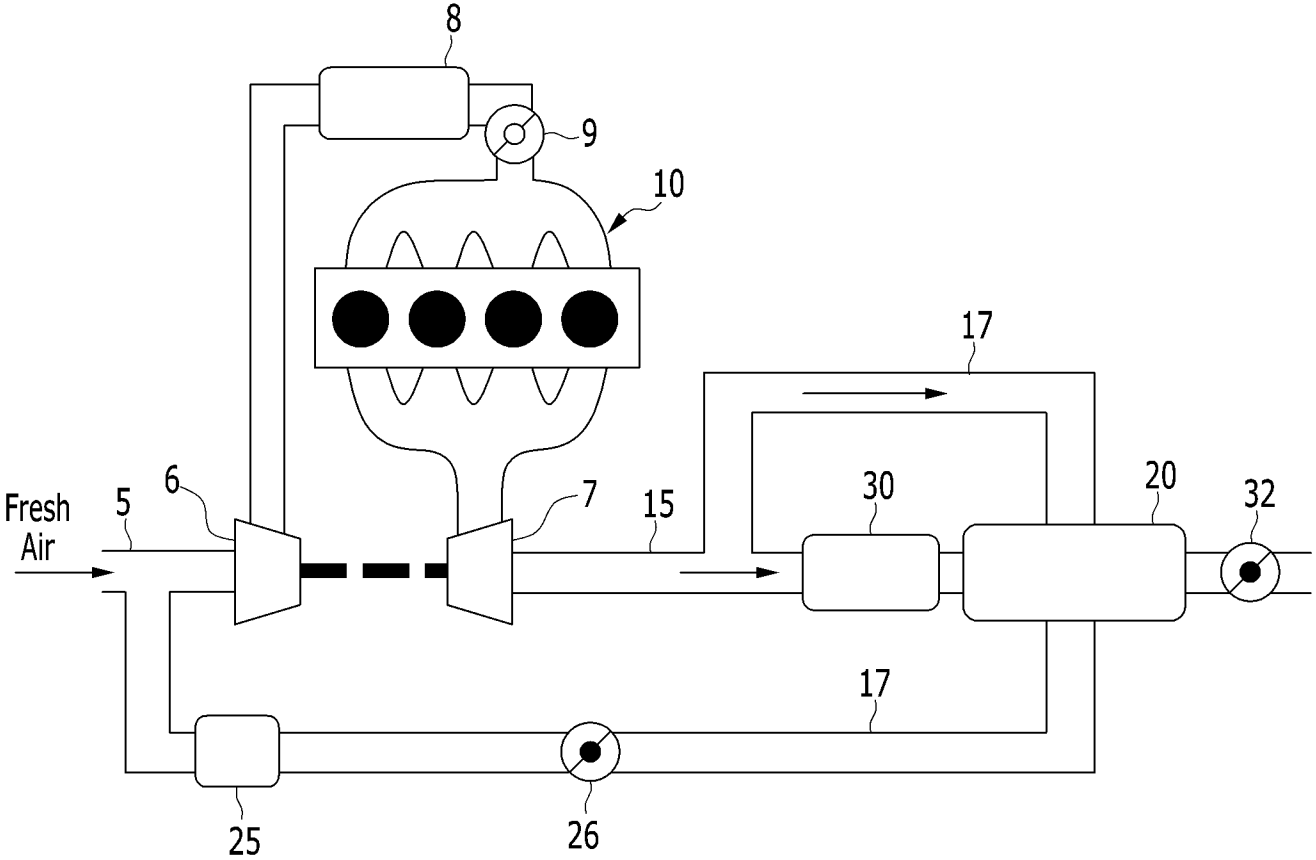
FIG. 1 is a schematic view illustrating a fuel reforming system.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure.

Further, in exemplary forms, since like reference numerals designate like elements having the same configuration, a first exemplary form is representatively described, and in other exemplary forms, only configurations different from the first exemplary form will be described.

The drawings are schematic, and are not illustrated in accordance with a scale. Relative dimensions and ratios of portions in the drawings are illustrated to be exaggerated or reduced in size for clarity and convenience, and the dimensions are just exemplified and are not limiting. In addition, same structures, elements, or components illustrated in two or more drawings use same reference numerals for showing similar features. It will be understood that when an element such as a layer, film, region, or substrate is referred to as being "on" another element, it can be directly on the other element or intervening elements may also be present.

The exemplary form of the present disclosure shows an exemplary form of the present disclosure in detail. As a result, various modifications of the drawings will be expected.

Now, a fuel reforming system as an exemplary form of the present disclosure will be described with reference to FIG. 1.

FIG. 1 is a schematic view illustrating a fuel reforming system in one form of the present disclosure.

Referring to FIG. 1, a reforming system includes an engine 10, an intake line 5, an exhaust line 15, a fuel reformer 20, and a catalyst 30.

The engine 10 burns air/fuel mixture in which fuel and air are mixed so as to convert chemical energy into mechanical energy. The engine 10 is connected to an intake manifold so as to receive the air in a combustion chamber, and is connected to an exhaust manifold such that exhaust gas generated in combustion process is gathered in the exhaust manifold and is discharged to outside of the engine. An injector is mounted in the combustion chamber so as to inject the fuel into the combustion chamber.

A diesel engine is exemplified herein, but a lean-burn gasoline engine may be used. In a case that the gasoline engine is used, the air/fuel mixture flows into the combustion chamber through the intake manifold, and a spark plug is mounted at an upper portion of the combustion chamber. In a case that the gasoline engine is used, the air/fuel mixture flows into the combustion chamber through the intake manifold, and a spark plug is mounted at an upper portion of the combustion chamber.

In addition, the engines having various compression ratios. For example, a compression ratio may be lower than or equal to approximately 16.5.

The intake line 5 is connected to an entrance of the engine 10 to supply reformed gas and air to the engine 10, and the exhaust line 15 is connected to an exit of the engine 10 to circulate exhaust gas exhausted from the engine 10.

A portion of the exhaust gas discharged from the engine is supplied to the engine 10 through the EGR line 17. Also, the EGR line 17 is connected to the intake manifold so that combustion temperature is controlled by mixing a portion of the exhaust gas with air. This combustion temperature control is conducted by adjusting exhaust gas amount supplied to the intake manifold. Accordingly, EGR valve 26 adjusting flow rate of the reformed gas may be installed at the EGR line 17.

An exhaust gas recirculation system realized by the EGR line 17 supplies a portion of the exhaust gas to the intake system and inflows to a combustion chamber when an amount of the nitrogen oxide needs to be reduced according to driving condition. Then, the supplied exhaust gas, as inert gas of which volume is not changed, depresses density of the air/fuel mixture, and flame transmitting speed is reduced during combustion of the fuel. Therefore, a combustion speed of the fuel is reduced, and an increase of the combustion temperature is reduced such that generation of the nitrogen oxide decreases.

A fuel reformer 20 is provided at an EGR line 17 diverging from the exhaust line 15, and mixes the EGR gas, which is diverging from the exhaust gas and passing through the EGR line 17, with the fuel and reforms the fuel mixed in the EGR gas.

The catalyst 30 is disposed at the exhaust line 15 and purifies nitrogen oxide included in the exhaust gas at a front end of the fuel reformer 20.

The catalyst 30 may include a lean NOx trap (LNT) which traps the nitrogen oxide included in the exhaust gas in a lean condition and desorbs the trapped nitrogen in a rich condition, and restores the nitrogen oxide included in the exhaust gas or the desorbed nitrogen oxide. The LNT may oxidize carbon monoxide (CO) and hydrocarbon (HC) included in the exhaust gas. Here, it should be understood that the hydrocarbon is used to imply compound including carbon and hydrogen in exhaust gas and fuel.

Also, the catalyst 30 may include a selective catalytic reducer (SCR) restoring the nitrogen oxide included in the exhaust gas by using reducing agent. The reducing agent may be urea injected from an injection module.

In one form, the fuel reforming may further include a compressor 6 connected to the intake line 5 and compresses the reformed gas and air to supply to the engine 10, and a turbine 7 which is connected to the exhaust line 15 and rotated by the exhaust gas to generate power.

Also, the reforming system may include an intercooler 8 connected to the compressor 6. Cooling air and reformed gas flow into the intake line 5 of the engine 10 again, and a throttle valve 9 adjusts a flow rate of the air and reformed gas.

An exhaust pressure control valve 32 adjusting a flow rate of the exhaust gas may be provided at a rear end of the catalyst 30 in the exhaust line 15.

Meanwhile, an EGR valve 26 adjusting a flow rate of the reformed gas, and an EGR cooler 25 which is disposed at a rear end of the EGR valve 26 and cools the reformed gas may be installed at the EGR line 17.

Here, the fuel reformer 20 may be disposed at a front portion of the EGR cooler 27 in the EGR line 17.

Figure 2:
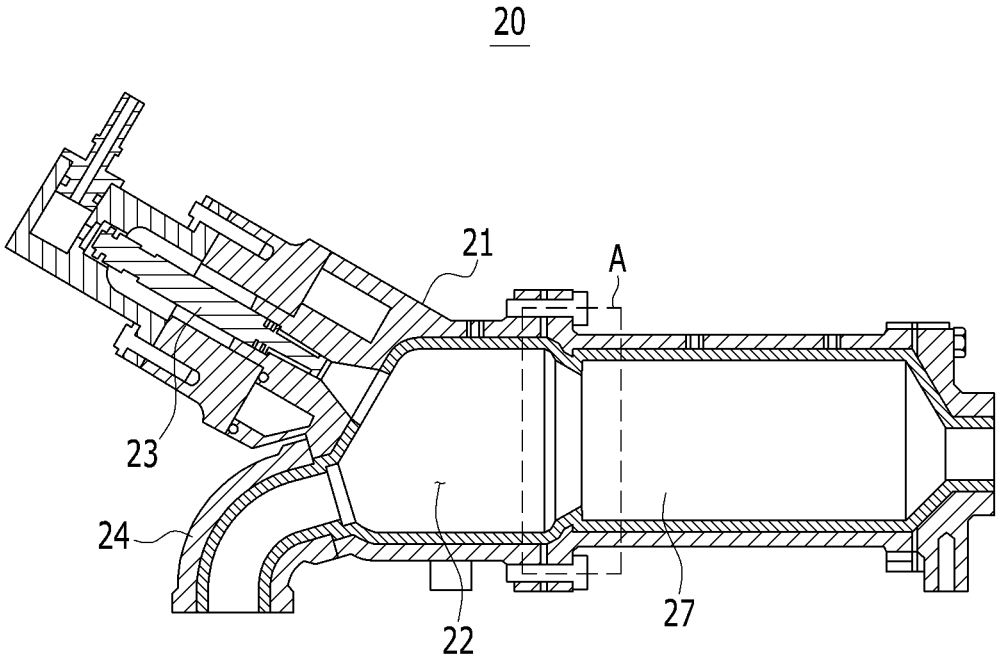
FIG. 2 is a schematic view illustrating a fuel reformer.
Figure 3:
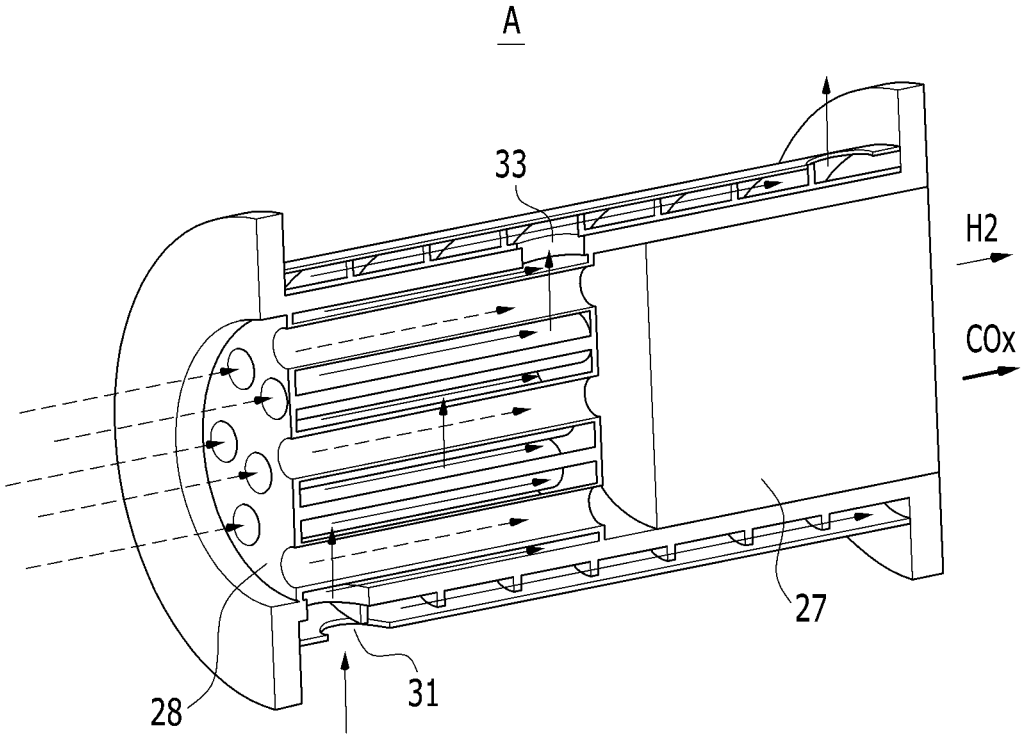
FIG. 3 is a schematic view illustrating a heat transfer portion of a fuel reformer.

FIG. 2 is a schematic view illustrating a fuel reformer in one exemplary form of the present disclosure, and FIG. 3 is a schematic view illustrating a heat transfer portion of a fuel reformer as an exemplary form of the present disclosure.

Referring to FIG. 2, the fuel reformer 20 includes a housing 21, a mixing portion 22 being a space for mixing the fuel supplied from outside with the EGR gas, a fuel injector 23 installed at one side of the housing 21 and supplying the fuel to the mixing portion 22, an EGR pipe 24 connected to the mixing portion 22 in which the EGR gas flows, a heat transfer portion A installed at a rear end of the mixing portion 22, and a reforming catalyst portion 27 provided at a rear end of the heat transfer portion A. The reforming catalyst portion 27 reforms the fuel and EGR gas mixed in the mixing portion 22.

Referring to FIG. 3, the heat transfer portion A includes a penetration member 28, an exhaust gas inlet 31 and an exhaust gas outlet 33.

The penetration member 28 has a plurality of penetration holes configured to circulate the fuel and EGR gas mixed in the mixing portion 22 toward the reforming catalyst portion 27.

The exhaust gas flows in the heat transfer portion A through the exhaust gas inlet 31 and flows out through the exhaust gas outlet 33. The exhaust gas flowed in the heat transfer portion A flows through the plurality of penetration holes formed at the penetration member 28 to transfer exhaust heat of the exhaust gas to the mixed fuel and EGR gas.

As shown in FIG. 3, the exhaust gas may be flowed in and out in a direction crossing to lengthwise direction of the penetration holes, and the exhaust gas may flows around the penetration holes to transfer exhaust heat to the fuel and EGR gas flowing through the penetration holes.

By this heat transfer structure, the exhaust heat is transferred to the fuel and EGR gas before the fuel and EGR gas flow in the reforming catalyst portion 27, therefore temperature of the fuel and EGR gas is sufficiently raised to a sufficient activation temperature of reforming catalyst.

Like this, a heat transfer structure of mixed gas and exhaust gas in a fuel reformer is provided to attain sufficient activation temperature of reforming catalyst for reforming reaction, therefore increasing generation of hydrogen and improves reforming efficiency.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

DESCRIPTION OF SYMBOLS

| | |
|---|---|
| 5: intake line | 6: compressor |
| 7: turbine | 8: intercooler |
| 9: throttle valve | 10: engine |
| 15: exhaust line | 17: EGR line |
| 20: reformer | 21: housing |
| 22: mixing portion | 23: fuel injector |
| 24: EGR pipe | 25: EGR cooler |
| 26: EGR valve | 27: reforming catalyst portion |
| 28: penetration member | 30: catalyst |
| 32: exhaust pressure control valve | 33: exhaust gas outlet |

What is claimed is:

1. A fuel reforming system, comprising:

an engine configured to combust reformed gas and to generate mechanical power;

an intake line connected to the engine and configured to supply the reformed gas and air to the engine;

an exhaust line connected to the engine and configured to circulate exhaust gas discharged from the engine;

a fuel reformer provided at an exhaust gas recirculation (EGR) line diverging from the exhaust line, the EGR line diverting a portion of the exhaust gas as EGR gas, the fuel reformer configured to mix the EGR gas with the fuel and to reform the fuel mixed in the EGR gas; and a catalyst disposed on the exhaust line and arranged between the fuel reformer and a diverging starting point at which the EGR line diverges from the exhaust line, the catalyst configured to purify nitrogen oxide included in the exhaust gas at a front end of the fuel reformer, wherein the fuel reformer includes:

a housing;

a mixing portion provided in the housing and being a space configured to mix the fuel supplied from outside and the EGR gas;

a fuel injector installed at one side of the housing and configured to supply the fuel to the mixing portion;

an EGR pipe connected to the mixing portion and configured to flow the EGR gas;

a heat transfer portion installed at a rear end of the mixing portion and configured to increase a temperature of the mixed fuel and EGR gas by heat of the exhaust gas; and a reforming catalyst portion provided at a rear end of the heat transfer portion and configured to reform the mixed fuel and EGR gas.

2. The fuel reforming system of claim 1, wherein the heat transfer portion includes:

a penetration member having a plurality of penetration holes configured to circulate the fuel and EGR gas mixed in the mixing portion toward the reforming catalyst portion; and an exhaust gas inlet and an exhaust gas outlet through which exhaust gas flows in and out such that the exhaust gas circulates around the plurality of penetration holes.

3. The fuel reforming system of claim 1, further comprising:

a compressor connected to the intake line and configured to compress the reformed gas and air to supply to the engine; and a turbine connected to the exhaust line and configured to be rotated by the exhaust gas to generate power.

4. The fuel reforming system of claim 1, wherein the catalyst includes a lean NOx trap (LNT) configured to trap the nitrogen oxide included in the exhaust gas in a lean condition and to desorb the trapped nitrogen in a rich condition, the LNT configured to restore the nitrogen oxide included in the exhaust gas or the desorbed nitrogen oxide.

5. The fuel reforming system of claim 1, wherein the catalyst includes a selective catalytic reducer (SCR) configured to restore the nitrogen oxide included in the exhaust gas by using a reducing agent.

6. The fuel reforming system of claim 1, wherein an EGR valve configured to adjust a flow rate of the reformed gas, and an EGR cooler disposed at a rear end of the EGR valve and configured to cool the reformed gas are both installed at the EGR line.

7. The fuel reforming system of claim 6, wherein the reformer is installed at a front portion of the EGR cooler in the EGR line.

* * * * *